US009846993B2

(12) United States Patent
Watkins

(10) Patent No.: US 9,846,993 B2
(45) Date of Patent: Dec. 19, 2017

(54) METHOD, APPARATUS, AND PROGRAM PRODUCT FOR EXTENDING A PLAY IN A WAGERING GAME

(71) Applicant: EVERI GAMES INC., Austin, TX (US)

(72) Inventor: Brian Alexander Watkins, Austin, TX (US)

(73) Assignee: Everi Games Inc., Austin, TX (US)

( * ) Notice: Subject to any disclaimer, the term of this patent is extended or adjusted under 35 U.S.C. 154(b) by 316 days.

(21) Appl. No.: 14/308,658

(22) Filed: Jun. 18, 2014

(65) Prior Publication Data

US 2015/0371487 A1 Dec. 24, 2015

(51) Int. Cl.

| | |
|---|---|
| ***A63F 9/00*** | (2006.01) |
| ***G07F 17/32*** | (2006.01) |
| *G07F 17/34* | (2006.01) |

(52) U.S. Cl.

CPC ..... *G07F 17/3267* (2013.01); *G07F 17/326* (2013.01); *G07F 17/34* (2013.01)

(58) Field of Classification Search

None

See application file for complete search history.

(56) References Cited

U.S. PATENT DOCUMENTS

| | | | | |
|---|---|---|---|---|
| 2007/0155474 | A1* | 7/2007 | Gauselmann | G07F 17/32 463/20 |
| 2008/0108411 | A1* | 5/2008 | Jensen | G07F 17/32 463/20 |
| 2009/0227342 | A1* | 9/2009 | Shai-Hee | G07F 17/3211 463/20 |
| 2014/0256402 | A1* | 9/2014 | Caputo | G07F 17/34 463/20 |
| 2015/0348374 | A1* | 12/2015 | Dupuis | G07F 17/3213 463/20 |

* cited by examiner

*Primary Examiner* — Seng H Lim

(74) *Attorney, Agent, or Firm* — Nathan Calvert, Esq; JP Cody, Esq.; Russell D. Culbertson, Esq.

(57) ABSTRACT

A method for extending a play in a reel-type wagering game includes first producing a game symbol array for a play in the wagering game. Any prizes indicated by the initial game symbol array are awarded. An evaluation is then be performed to determine if a triggering condition is associated with the initial game symbol array. Where the evaluation detects the triggering condition, at least one line of game symbols is shifted in a shifting direction by a selected number of symbol locations. This shift creates a new game symbol array for which additional prizes may be awarded. Then the evaluation for the triggering condition is conducted again for the new game symbol array and the process repeats. The process continues until no triggering condition is detected for a given symbol array or until some other condition terminates the play.

20 Claims, 9 Drawing Sheets

METHOD, APPARATUS, AND PROGRAM PRODUCT FOR EXTENDING A PLAY IN A WAGERING GAME

TECHNICAL FIELD OF THE INVENTION

The invention is related to wagering games, particularly reel-type wagering games, in which play may extended for a given activation of the game to create additional opportunities for winning symbol combinations. The invention encompasses methods, gaming machines and systems, and corresponding program products.

BACKGROUND OF THE INVENTION

Numerous different types of reel-type gaming machines have been developed to provide desirable game features and play characteristics in these types of wagering games. As used in this disclosure and the accompanying claims, a reel-type gaming machine comprises a gaming machine in which at least some results are displayed to the player in the form of an array of game symbols, where each game symbol is displayed on the periphery of a spinnable reel, either a physical reel or a video simulation of such a reel. For example, a reel-type gaming machine may include a display system with five adjacent reels (either physical reels or video simulations) all aligned along a horizontal axis of rotation, with each reel showing a line of three or more game symbols in the array of symbols. Other reel-type gaming machines may show only a single symbol on each physical or simulated reel and include a separate physical or simulated reel for each symbol location in the array of game symbols used to display results. In all of these reel-type gaming machines, winning results are shown at least partially by the particular pattern or patterns of game symbols appearing in the array of game symbols for a given play of the game.

One feature that has been applied in reel-type gaming machines can generally be referred to as a respin feature. For example, U.S. Pat. No. 5,704,835 shows a respin feature in which a player may select one or more reels to respin in order to generate new game symbols for the array. Another type of respin game awards some number of free spins and allows the player to play their free spins in an effort to win additional prizes. U.S. Pat. No. 7,121,942 shows an example of a free spin game. Yet other types of reel-type gaming machines include a "nudge" feature in which the reels initially come to rest for a play of the game, and then one or more of the reels "nudge," that is, move to the next stop position to make the final array of game symbols for the play of the game. U.S. Patent Application Publication No. 2004/0048650 shows such a nudge feature. Although all of these types of game features may provide improvement over the basic reel-type game play, there remains a need to provide new game features which can capture and maintain the player's interest and provide a more satisfying gaming experience.

SUMMARY OF THE INVENTION

The present invention provides a feature for a reel-type game which can increase player excitement and otherwise provide an improved gaming experience. In particular, the invention provides a feature which extends a play in a reel-type game so as to provide the player with additional chances to win a prize for a given play in the game.

A method for extending a play in a reel-type wagering game according to one embodiment of the present invention includes first producing a game symbol array for a play in the wagering game. The game symbol array includes a number of lines of symbol locations and with at least some of the symbol locations being populated with a respective game symbol selected from one or more game symbol sets. For example, the game symbol array may be produced by a number of reels, with each reel showing a number of game symbols for the array and thus producing a line of symbol locations. Once the initial game symbol array is produced for the play in the game, any prizes indicated by the game symbol array may be awarded. An evaluation may then be performed to determine if a triggering condition is associated with the initial game symbol array. If no triggering condition is associated with the initial game symbol array, then the play simply terminates and the gaming machine is made ready to receive the next game play entered by a player. However, where the evaluation detects the triggering condition, the invention includes going through at least one change of the game symbol array in an effort to produce additional winning combinations of game symbols. In particular, an additional game symbol array is produced by shifting the game symbols populating each respective line of symbol locations in a shifting direction by a selected number of symbol locations along that line of symbol locations. Any symbol location that is vacated by the shift is populated with a new game symbol. Once the shift is complete to create a new game symbol array, any prizes indicated by the new game symbol array are awarded to the player. Then the evaluation for the triggering condition is conducted again for the new game symbol array and the process repeats. If the triggering condition is not present the game play ends. If the triggering condition is present, the game symbols shift again to create another game symbol array, and any prizes are paid for that new array. The process continues until no triggering condition is detected for a given symbol array or until some other condition terminates the play.

It should be noted that each shift of game symbols is not simply a spin of the respective reel which defines that line of symbol locations. Rather each shift of game symbols is a shift of a selected number of locations along that line of symbol locations. Each shift is defined by the starting position and represents a shift of some selected number of symbol locations in the shifting direction rather than a randomization to produce a new stop location. In preferred implementations, the number of locations for a given shift will be limited to between one location up to the number of locations along a line of symbol locations visible in the game symbol array. For example, if the game symbol array has four visible symbols along a line of symbol locations in the array, a shift may be between one and four symbol locations for that line of symbol locations.

The invention encompasses numerous variations on the basic process of producing an array of game symbols, paying prizes shown in that array, evaluating for a triggering condition, and then shifting the lines of symbol locations to produce a new array upon the occurrence of the trigger condition, and repeating the steps until no triggering condition is detected. In some embodiments, the number of locations by which the lines of symbol locations shift is the same for each shift in the game. Each line of symbol locations may shift by the same number of symbol locations for a given play or by different numbers of symbol locations for the play. In yet other embodiments, the number of locations the lines of symbol locations shift may be based on some aspect of the then current state of the symbol array. Also, the triggering condition may be any suitable condition. For example, the triggering condition may simply be a winning pattern in the symbol array for which the evaluation is performed. In other embodiments the trigger condition may be determined at random without regard to the symbol array. In any event, the invention has particular application where at least one of the lines of symbol locations is populated by a set sequence of game symbols that includes a stack of adjacent special symbols such as wild symbols. This arrangement can generate player excitement because the player can anticipate the symbols that will appear after the next shift and the anticipated symbols may be ones, such as wild symbols, which enhance the chance of producing a winning combination.

A gaming machine according to some embodiments of the present invention includes a display system having at least one display device, a player input system, and at least one processor. One or more memory devices are associated with the processor or processors for storing instructions which are executable by the processor or processors to perform the various operations described above in this section. In particular, the processor or processors execute instructions to cause the display system to produce an initial array of game symbols and, then, upon detection of the triggering condition, shift the game symbols along the different lines of symbol locations to create a new array, and then repeat evaluation and shifting processes until no triggering condition is detected. The processor or processors also execute instructions to award the prizes indicated by each symbol array produced in the process for a given game play, the initial array produced in the game and each new array produced according to the symbol shifting process.

Considering that the present invention may be implemented using one or more general purpose processors, the invention also encompasses program products comprising tangible and non-transitory computer readable data storage devices storing program code. The stored program code may include game program code and award program code. The game program code may be executable to cause a display system of a gaming machine to produce the initial and any subsequent symbol arrays as described above. The award program code may be executable to award the prizes shown in each different symbol array produced for the game play.

These and other advantages and features of the invention will be apparent from the following description of illustrative embodiments, considered along with the accompanying drawings.

DESCRIPTION OF ILLUSTRATIVE EMBODIMENTS

In the following description, FIGS. 1-3 will be used to describe example gaming machines and gaming networks through which the present invention may be implemented. Processes which are illustrative of various embodiments of the invention will then be described in connection with the flow chart of FIG. 4. FIGS. 5 through 9 will then be used to describe various graphic game displays which may be presented according to embodiments of the present invention.

Figure 1:
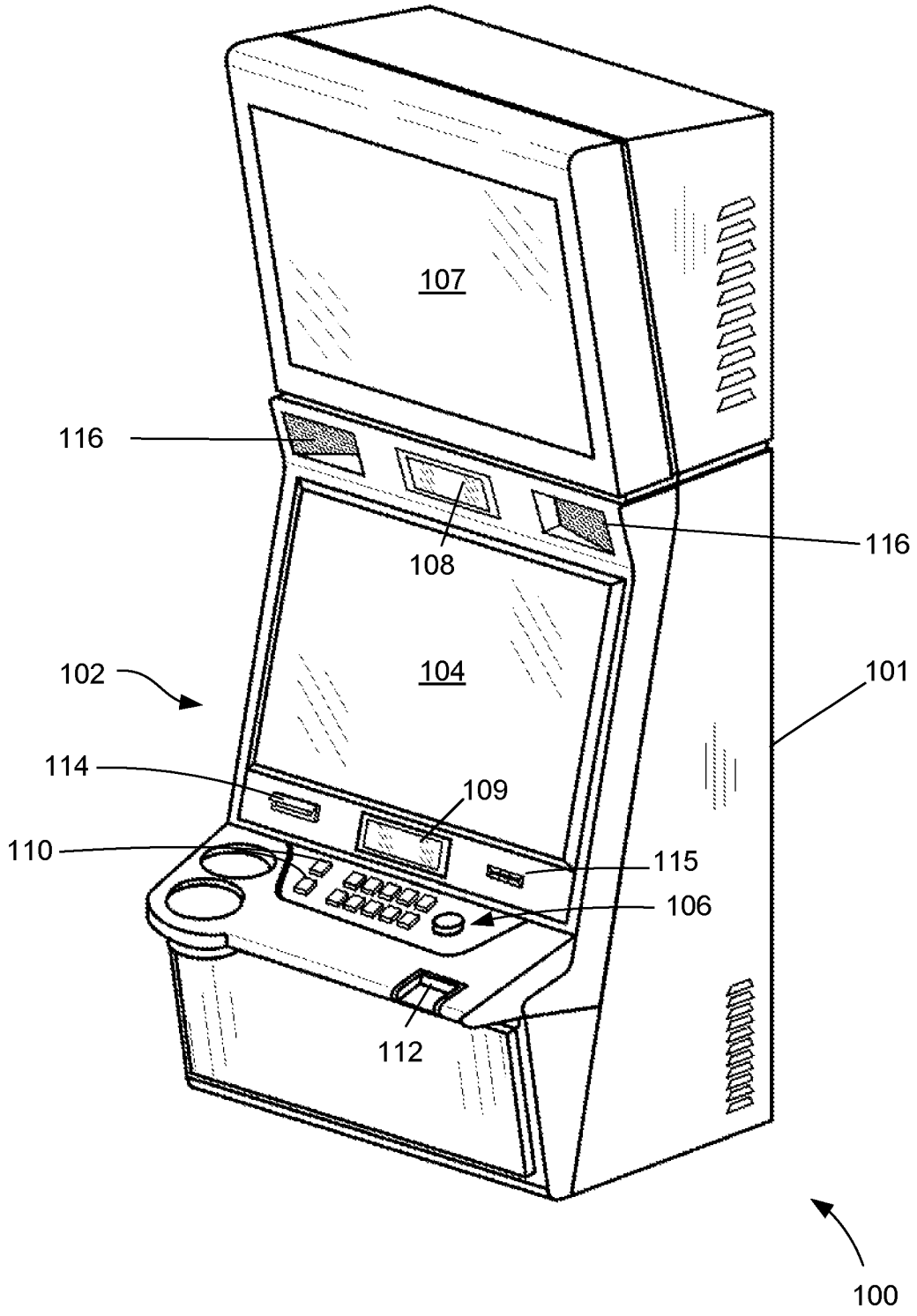
FIG. 1 is a view in perspective of a gaming machine which may be employed to implement various embodiments of the present invention.

FIG. 1 shows a gaming machine 100 that may be used in implementing a wagering game utilizing a play extending process according to the present invention. The block diagram of FIG. 2 shows further details of gaming machine 100 along with certain variations which may be included in the gaming machine. FIG. 3 shows an example gaming network in which gaming machines such as gaming machine 100 may be employed.

Referring to FIG. 1, gaming machine 100 includes a cabinet 101 having a front side generally shown at reference numeral 102. A primary video display device 104 is mounted in a central portion of the front side 102, with a button panel 106 positioned below the primary video display device and projecting forwardly from the plane of the primary video display device. In addition to primary video display device 104, the illustrated gaming machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future. One or more of these video display devices, and especially primary video display device 104, may be used to display graphics used to implement a game play according to the present invention. As will be described further below in connection with FIG. 2 and elsewhere, it is also possible for gaming machines within the scope of the present invention to include mechanical elements such as mechanical reels. In these mechanical reel implementations, the mechanical reels may be used to display results of a game play according to embodiments of the present invention. Generally, the display device or display devices of the gaming machine, whether video display devices, mechanical devices, or combinations of the two, which are used to display games according to embodiments of the invention, may be described in this disclosure and the accompanying claims as a display system.

The gaming machine 100 illustrated for purposes of example in FIG. 1 also includes a number of mechanical control buttons 110 mounted on button panel 106. These control buttons 110 may allow a player to select a bet level, select paylines, select a type of game or game feature, and make a play input to start a play in a game. Other forms of gaming machines through which the invention may be implemented may include switches, joysticks, or other mechanical input devices, and/or virtual buttons and other controls implemented on a suitable touch screen video display. For example, primary video display device 104 in gaming machine 100 provides a convenient display device for implementing touch screen controls in addition to or in lieu of mechanical controls included on button panel 106. The player interface devices which receive player inputs in the course of a game played through the gaming machine, such as controls to select a wager amount for a given play, controls to enter a play input to actually start a given play in the wagering game, or controls to allow a player to make other player selections in a game according to the present invention, may be referred to generally as a player input system.

It will be appreciated that gaming machines may also include a number of other player interface devices in addition to devices that are considered player controls for use in playing a particular game. Gaming machine 100 also includes a currency/voucher acceptor having an input ramp 112, a player card reader having a player card input 114, and a voucher/receipt printer having a voucher/receipt output 115. Numerous other types of player interface devices may be included in gaming machines that may be used to implement embodiments of the present invention.

A gaming machine which may be used to implement embodiments of the present invention may also include a sound system to provide an audio output to enhance the user's playing experience. For example, illustrated gaming machine 100 includes speakers 116 which may be driven by a suitable audio amplifier (not shown) to provide a desired audio output at the gaming machine.

Figure 2:
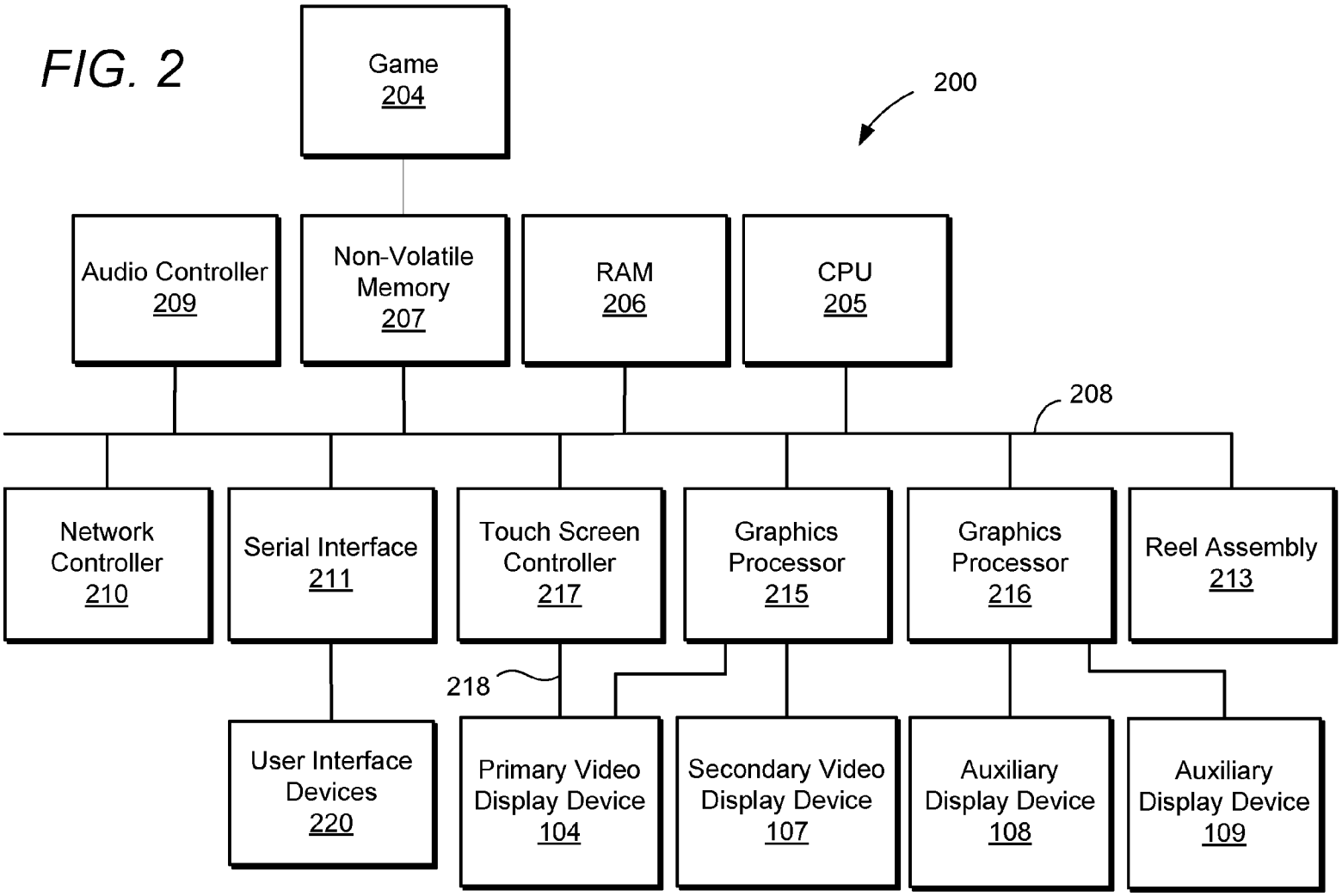
FIG. 2 is a diagrammatic representation of the gaming machine shown in FIG. 1 showing various components of the gaming machine.

FIG. 2 shows a logical and hardware block diagram 200 of gaming machine 100 which includes a processor (CPU) 205 along with random access memory (RAM) 206 and nonvolatile memory or storage device 207. All of these devices are connected on a system bus 208 with an audio controller device 209, a network controller 210, and a serial interface 211. A graphics processor 215 is also connected on bus 208 and is connected to drive primary video display device 104 and secondary video display device 107 (both mounted on cabinet 101 as shown in FIG. 1). A second graphics processor 216 is also connected on bus 208 in this example to drive the auxiliary display devices 108 and 109 also shown in FIG. 1. As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of the respective display device, in this case primary video display device 104. The touch screen element itself is not illustrated or referenced separately in the figures.

Those familiar with data processing devices and systems will appreciate that other basic electronic components will be included in gaming machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements may be mounted on a standard personal computer chassis and housed in a standard personal computer housing which itself may be mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio controller 209, for example, may be connected to the system via a PCI or PCIe bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention. For example, a gaming machine in some embodiments of the present invention may rely on one or more data processors which are located remotely from the gaming machine itself. Embodiments of the present invention may include no processor such as CPU 205 or graphics processors such as 215 and 216 at the gaming machine, and may instead rely on one or more remote processors. Thus unless specifically stated otherwise, the designation "gaming machine" is used in this disclosure and the accompanying claims to designate a system of devices which operate together to provide the indicated functions. A "gaming machine" may include a gaming machine such as gaming machine 100 shown in FIGS. 1 and 2, which is itself a system of various components, and may also include one or more components remote from a gaming machine cabinet (that is, cabinet 101 in FIG. 1). Thus the designation "gaming machine" encompasses both a standalone gaming machine and a gaming machine (that is, the part housed in a cabinet such as cabinet 101 in FIG. 1) along with one or more remote components for providing various functions (such as generating outcomes for plays in a game, and driving display devices mounted in a gaming machine cabinet).

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, CPU 205 or a graphics processor packaged with or included with CPU 205 may control all of the display devices directly without any separately packaged graphics processor. The invention is not limited to any particular arrangement of processing devices for controlling the video display devices included with gaming machine 100. Also, a gaming machine implementing the present invention is not limited to any particular number of video display devices or other types of display devices.

In the illustrated gaming machine 100, CPU 205 executes software, that is, program code, which ultimately controls the entire gaming machine including the receipt of player inputs and the presentation of the graphics or information displayed according to the invention through the display devices 104, 107, 108, and 109 associated with the gaming machine. CPU 205 also executes software related to communications handled through network controller 210, and software related to various peripheral devices such as those connected to the system through audio controller 209, serial interface 211, and touch screen controller 217. CPU 205 may also execute software to perform accounting functions associated with game play. Random access memory 206 provides memory for use by CPU 205 in executing its various software programs while the nonvolatile memory or storage device 207 may comprise a hard drive or other mass storage device providing storage for game software such as program code 204 (which may include the game program code and award program code) prior to loading into random access memory 206 for execution, or for programs not in use or for other data generated or used in the course of gaming machine operation. Network controller 210 provides an interface to other components of a gaming system in which gaming machine 100 may be included. An example network will be described below in connection with FIG. 3.

It should be noted that the invention is not limited to gaming machines employing the personal computer-type arrangement of processing devices and interfaces shown in example gaming machine 100. Other gaming machines through which the invention may be implemented may include one or more special purpose processing devices to perform the various processing steps for implementing the invention. Unlike general purpose processing devices such as CPU 205, which may comprise an Intel Pentium® or Core® processor for example, these special purpose processing devices may not employ operational program code to direct the various processing steps.

The example gaming machine 100 which may be used to implement some embodiments of the present invention is shown in FIG. 2 as including user interface devices 220 (part of a player input system) connected to serial interface 211. These user interface devices may include various player input devices such as mechanical buttons shown on button panel 106 in FIG. 1, and/or levers, and other devices. It will be appreciated that the interface between CPU 205 and other player input devices such as player card readers, voucher readers or printers, and other devices may be in the form of serial communications. Thus serial interface 211 may be used for those additional devices as well, or the gaming machine may include one or more additional serial interface controllers. However, the interface between peripheral devices in the gaming machine, such as player input devices, is not limited to any particular type or standard for purposes of the present invention.

Reel Assembly 213 is shown in the diagrammatic representation of FIG. 2 to illustrate that a gaming machine which may be used for various embodiments of the present invention may include mechanical reels. For example, a set of mechanical reels may replace the primary display device 104, or at least part of that display device. Alternatively, mechanical reels may be included in the gaming machine behind a light-transmissive video display panel. In either case, the mechanical reels represent a display device for displaying various game symbols in the course of a game play. Although the invention is not limited to any particular mechanical reel arrangement or control system, mechanical reels may be controlled conveniently through serial communications which provide instructions for a respective stepper motor for each reel. Thus some embodiments of the present invention which employ mechanical reels may use a serial interface device such as serial interface 211 to control communications with the reel assembly, and may not include a direct bus interconnection as indicated by FIG. 2. Details of a mechanical reel arrangement and various accent lighting arrangements which may be associated with mechanical reels are not shown in the present figures so as to avoid obscuring the present invention in unnecessary detail.

Figure 3:
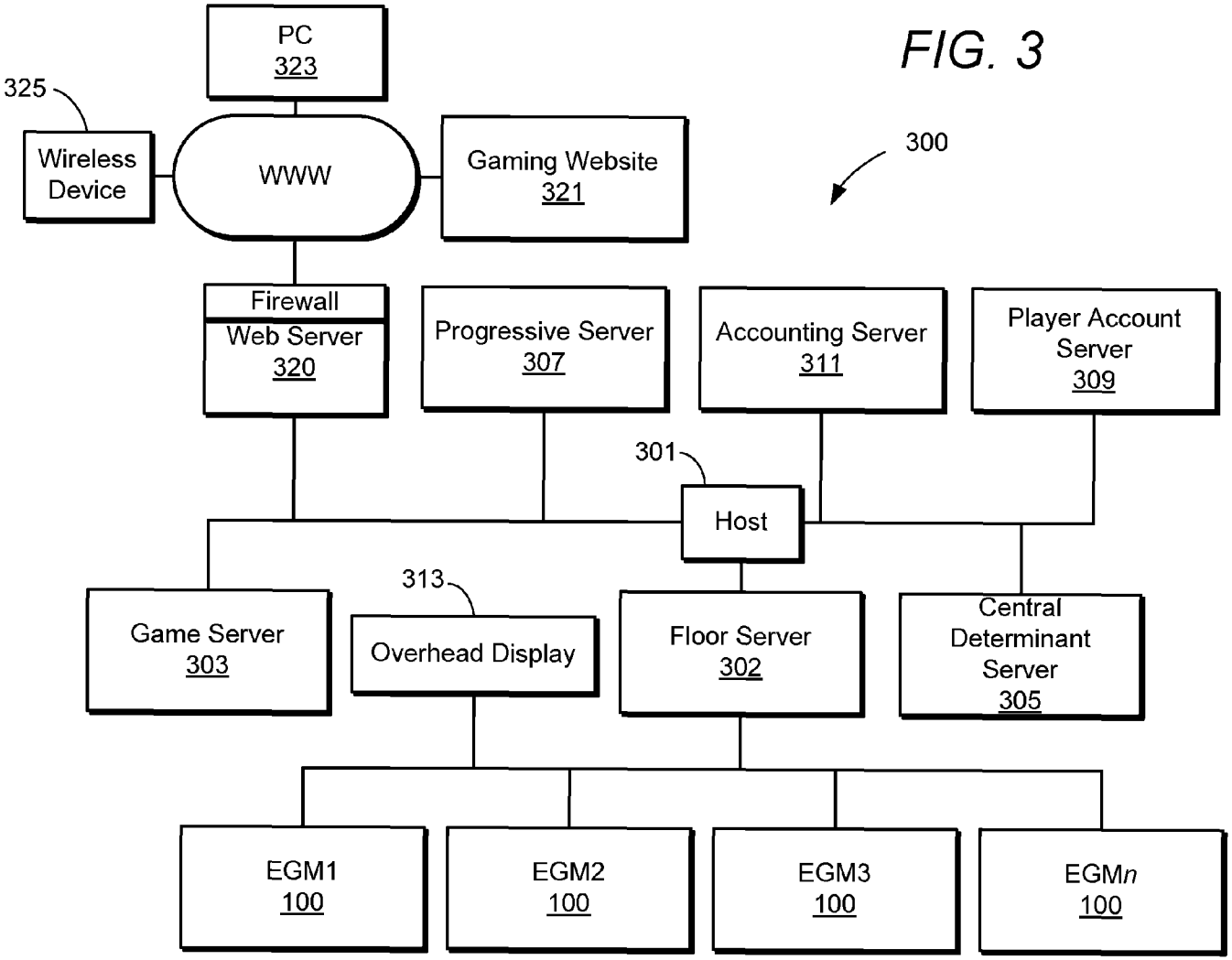
FIG. 3 is a diagrammatic representation of a gaming network in which the present invention may be implemented.

Referring now to FIG. 3, a networked gaming system 300 associated with one or more gaming facilities may include one or more networked gaming machines 100 ("electronic gaming machines" or "EGM's") connected in the network by suitable network cable or wirelessly. Networked gaming machines 100 (EGM1-EGMn) and one or more overhead displays 313 may be operatively connected so that the overhead display or displays may mirror or replay the content of one or more displays of gaming machines 100. For example, the primary display content for a given gaming machine 100 (including a game play according to the present invention) may be transmitted through network controller 210 to a controller associated with the overhead display(s) 313. In the event gaming machines 100 have cameras installed, the respective player's video images may be displayed on overhead display 313 along with the content of the player's gaming machine display.

The example gaming network 300 shown in FIG. 3 includes a host server 301 and floor server 302, which together may function as an intermediary between floor devices such as gaming machines 100 and back office devices such as the various servers described below. Game server 303 may provide server-based games and/or game services to network connected gaming devices such as gaming machines 100. Central determinant server 305 may be included in the network to identify or select lottery, bingo, or other centrally determined game outcomes and provide the outcome information to networked gaming machines 100 which present the games to players.

Progressive server 307 may maintain progressive pools for progressive games which may be available through the various gaming machines 100. In some implementations, progressive server 307 may simply receive communications indicating contribution amounts which have been determined by processes executing at the various gaming machines 100 or elsewhere in the gaming network. Alternatively, progressive server 307 may perform processes to determine the contribution amounts for incrementing the various progressive pools which may be maintained. Progressive server 307 may also periodically communicate current pool values back to the various gaming machines 100, and may participate in communicating awarded progressive prize amounts to the gaming machines and making adjustments to the progressive prize pools accordingly. In some implementations, progressive server 307 may also determine or participate in determining when a progressive prize triggering event occurs.

Accounting server 311 may receive gaming data from each of the networked gaming devices, perform audit functions, and provide data for analysis programs. Player account server 309 may maintain player account records, and store persistent player data such as accumulated player points and/or player preferences (for example, game personalizing selections or options).

Example gaming network 300 also includes a gaming website 321 which may be hosted through web server 320 and may be accessible by players via the Internet. One or more games may be displayed as described herein and played by a player through a personal computer 323 or handheld wireless device 325 (for example, a Blackberry® cell phone, Apple® iPhone®, personal digital assistant (PDA), iPad®, etc.). To enter website 321, a player may log in with a user name that may, for example, be associated with the player's account information stored on player account server 309. Once logged in to website 321 the player may play various games on the website, including games according to the invention. Also website 321 may allow the player to make various personalizing selections and save the information so it is available for use during the player's next gaming session at a casino establishment having the gaming machines 100.

It will be appreciated that gaming network 300 illustrated in FIG. 3 is provided merely as an example of a gaming network in which wagering games featuring play extension according to embodiments of the present invention may be implemented, and is not intended to be limiting in any way. The invention is not limited to use in games offered through a gaming network (via the gaming website 321, or via gaming machines such as gaming machines 100, or otherwise). For example, play extension games according to the present invention may be offered through a stand-alone gaming machine having a configuration similar to gaming machine 100 or having any other gaming machine configuration. Also, where play extension games as described herein are offered through gaming machines included in a gaming network, the network need not have the configuration shown for purposes of example in FIG. 3. In particular, servers shown separately in the example of FIG. 3 may be combined in a single physical processing device, or the processing duties of the various illustrated servers may be split into additional physical devices.

Figure 4:
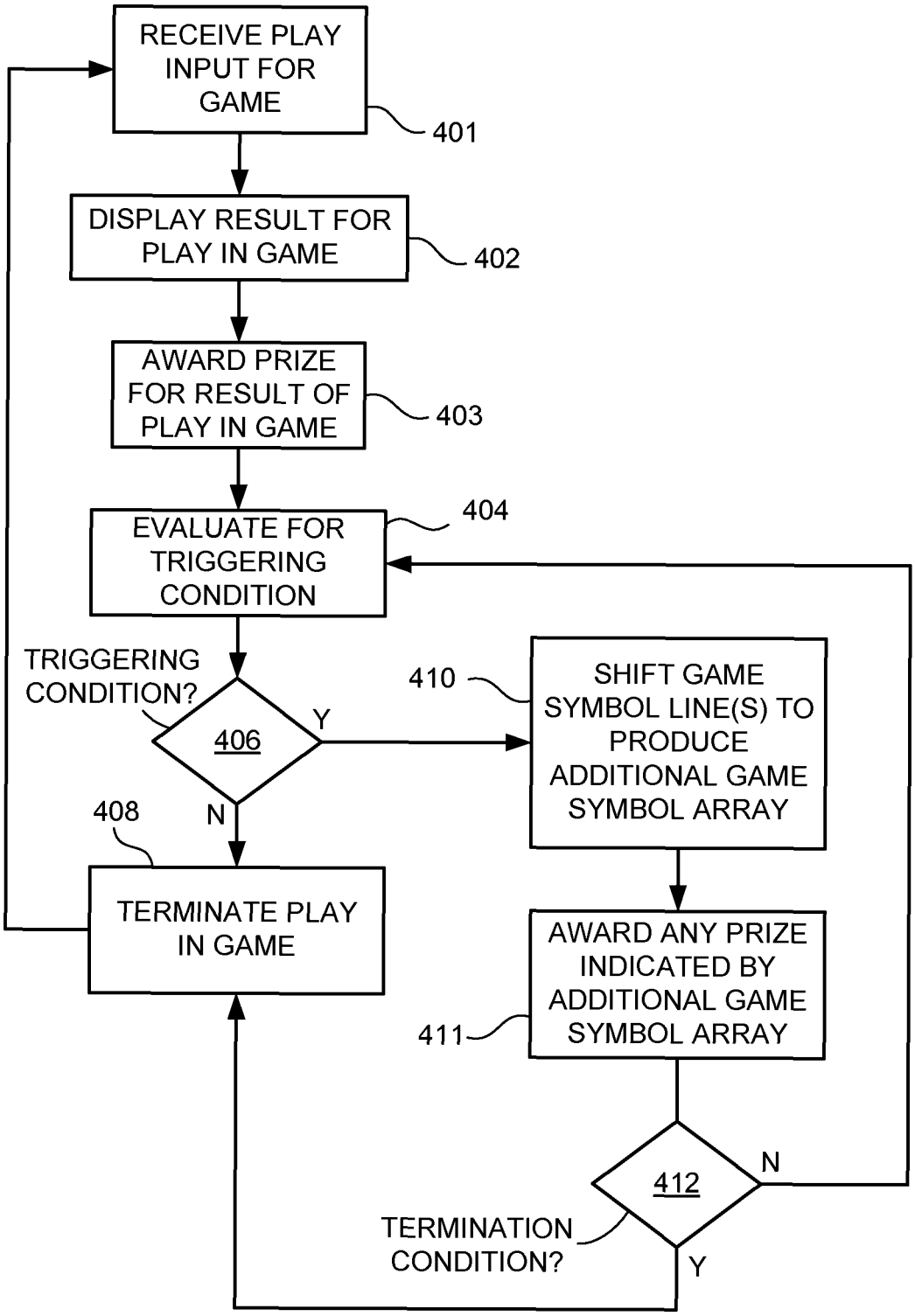
FIG. 4 is a flow diagram illustrating process steps according to one or more embodiments of the present invention.

FIG. 4 comprises a process flow diagram showing an example process within the scope of the present invention. The process begins by receiving a play input for a play in a wagering game as shown in a process block 401. In response to the play input, the process includes displaying a result for the play in the game as shown in a process block 402. The result is displayed at least partially by a game symbol array such as may be produced by a series of spinnable reels with each reel defining a line of symbol locations populated with game symbols. Any prizes indicated in the displayed result are awarded as indicated at process block 403. The illustrated method next includes evaluating for a triggering condition as indicated at process block 404. If the triggering condition is not present as indicated by a negative outcome at decision box 406, the play in the game terminates as shown at process block 408 and the process loops back to receive the next play input at process block 401. If the triggering condition is present as indicated by an affirmative outcome at decision box 406, the process next includes shifting one or more lines of symbol locations in the currently displayed game symbol array to produce an additional game symbol array as shown at process block 410. Any prizes indicated by the additional game symbol array are awarded as shown at process block 411. In this example process if there is no condition to terminate the play in the game as indicated by a negative outcome at decision box 412, the process loops back to process block 404 to evaluate for the triggering condition associated with the then-current game symbol array, that is, the game symbol array produced by the shift indicated at process block 410. However if a condition exists to terminate the play in the game as indicated by an affirmative outcome at decision box 412, the play in the game terminates as shown at process block 408 and the process loops back to receive the next play input for the game at process block 401.

It should be noted that the illustrative process shown in FIG. 4 omits any initialization step which is typically required before a gaming machine is in condition to receive a game play input. Methods according to the invention may be employed in gaming systems that utilize any gaming machine initialization process. For example, it may be necessary for a player to log in at a given gaming machine using a player identifier or player card in order to place the gaming machine in condition to receive a game play input to initiate a play in the game. As another example, it may only be necessary for a player to insert cash into the gaming machine or insert a cash-in ticket or otherwise place value on the gaming machine (that is, in memory associated with the gaming machine) to place the gaming machine in condition to receive a game play input to initiate a play in the game. The step or steps associated with initializing the gaming machine at the outset of play in the wagering game are omitted from FIG. 4 so as not to obscure the invention in unnecessary detail. Also, the present invention is not limited to any particular type of wager which may be placed in the game. The wager may be of cash or some type of cash equivalent such as credits redeemable for cash. It is also possible for a wager to be in some non-monetary value, such as player loyalty points, or some other non-monetary value.

Although not shown in FIG. 4, the wagering game process may include a separate step of obtaining a game result in some fashion so that the result may be displayed as indicated at process block 402. Obtaining a game result for the game play input may be performed in any number of ways. For example, results may be obtained through a bingo game as in a class II gaming system, or may be obtained by drawing a lottery record as in some class III gaming systems. As another example, a gaming system may employ a centralized or local random result generator and the step of obtaining a result may include issuing a request to that result generator and receiving the generated result. The gaming machine may then interpret the received result as necessary and generate a corresponding display through the display system of the gaming machine. For example, the received result may indicate a certain prize or result in a reel-type game, and the gaming machine may then control mechanical or virtual (video-generated) reels to show the indicated result. In other implementations of a wagering game according to the invention, the gaming machine may randomly select a number of game symbols which form the displayed result at process block 402, and then any prize associated with that result is identified from evaluating that display. This latter arrangement for obtaining a result for the game play input would be the case where the underlying game is a reel-type game utilizing independent random reel stops to identify a result for the game play input.

Regardless of how a result is displayed for the primary game as indicated at process block 402, the illustrated game process ultimately includes awarding any prize associated with that result. The awarding step shown at process block 403 in FIG. 4 may be accomplished, for example, by increasing a credit meter at the gaming machine by an amount correlated to the prize which has been won. This may be done under the control of a processor (such as processor 205 in FIG. 2) at the gaming machine or a remote processor. Alternatively, the gaming machine may issue currency or some currency equivalent for the prize which has been won, issue some physical object, or some other type of value or benefit. Cash prizes and some other types of physical prizes may be dispensed by a suitable mechanism at the gaming machine, and large value prizes of any type may be awarded via a hand pay process as is known in the art. The invention is not limited to any particular arrangement or method of awarding prizes at process block 403 in FIG. 4.

It should also be noted that the step of awarding a prize as shown at process block 403 in FIG. 4 need not be performed immediately after displaying the result and before any of the other steps shown in the process as indicated by the figure. Rather, any prizes for a winning result for the play input may be awarded at any suitable point in the process such as part of an end play sequence prior to returning to receive the next play input at process block 401. More generally, many of the steps indicated for the game shown in FIG. 4 may be performed in some other order without departing from the scope of the present invention.

The nature of the evaluation indicated that process block 404 will depend upon both the triggering condition defined for that evaluation and upon the manner in which results are obtained in the game. In some cases the triggering condition is defined as some characteristic of the game symbol array displayed according to process block 402. In these cases the evaluation step at process block 404 may include evaluating the symbol array in some fashion, either directly or indirectly. For example a winning symbol combination in the then currently displayed symbol array may be defined as the triggering condition. The evaluation at process block 404 in that case may include evaluating the then current symbol array for the presence of a winning symbol combination, or the evaluation process may include evaluating some other information which dictates the state of the game symbol array. For example, when results are defined by an outcome provided by central determinant class II or class III system or some other central determinant system, the communication from the result server will include information indicating whether a win is present and is to be displayed in the game symbol array at process block 402. In this case, the evaluation process at block 404 may comprise evaluating the outcome communication from the central determinant result server to determine whether the required winning symbol combination is present in the array displayed as indicated at process block 402.

In other forms of the invention, the evaluation indicated at process block 404 may be unrelated to the result shown on the then current game symbol array. For example, the triggering condition for a given instance of the evaluation at process block 404 may be randomly selected from a number of different potential triggering conditions. In this case, the evaluation may be of a number randomly selected from a range of potential numbers. It is also possible that the triggering condition may be received from a server. In this case, the evaluation comprises evaluating a communication received from the server.

The shifts of one or more lines of game symbols indicated at process block 410 may be accomplished in any suitable fashion consistent with the manner in which the symbols for the array are determined. For example, where the gaming machine display includes series of physical reels (with a set sequence of symbols on their periphery) which are spun and then each stopped at a respective stop position to show a line of game symbols for the array, the reels may simply be shifted the desired number of symbol locations under the control of the reel driving mechanism (which may be a stepper motor or some other suitable driving device). Where the result is displayed through a video simulation of physical reels which include a set sequence of symbols, the display may be driven to show each simulated reel shifting the selected number of positions or stops. In some cases, a video simulated reel may not be associated with a set sequence of game symbols but rather the symbols are randomly selected for displaying a game symbol array comprising a respective result for a play the game. In these cases, shifting a game symbol line may include randomly selecting a game symbol for each location shift along the given line of symbols, and these randomly selected symbols are shown in the simulated reel to shift in place as the original symbols shift out of the display area for the array.

There are numerous variations possible within the scope of the invention regarding the number of locations to be shifted for a given line of symbols defined by a given reel and which line of symbols to shift. In some implementations of the invention the number of locations shifted at process block 410 may be the same for all reels. In other cases the number of locations shifted may be different for each of the reels. It is also possible for an implementation to allow a player to select the number of locations to be shifted for a given reel. Regardless of the specific shift of symbol lines shown at process block 410, the shifts produces an additional game symbol array, that is, an array different from the one shown immediately prior to the shift. It is this shift of symbol locations and creation of a different game symbol array that provides the opportunity for additional wins in the same play of the game.

It should be noted that some forms of the invention may shift each game symbol line which is shifted in the course of the game some set number of locations for each instance of the step at process block 410. Where each line of symbols is produced from a set sequence of game symbols, no additional result is necessary to obtain the new game symbol array which may be evaluated for winning symbol combinations. Thus additional wins may be provided from a single-game result obtained in the game which defines an initial result but not necessarily all results produced over the course of the game play from symbol shifting according to the invention.

Regardless of how the shifting of game symbol lines is performed at process block 410, the process includes awarding prizes indicated by the new game symbol array as indicated at process block 411. Awarding prizes may require an evaluation of the new array to identify winning symbol combinations. Alternatively, the symbol array resulting from the shift may be apparent from the initial state of the array and the number of shifts performed at process block 410. Regardless of the manner in which prizes are determined or identified in the new game symbol array, these prizes may be awarded in any suitable fashion similarly to the awarding step shown at process block 403.

The example of FIG. 4 shows that the number of shifts which may be performed for a given game play at process block 410 may be limited in some fashion. For example, an implementation of a game according to the invention may set a maximum number of times the process may loop through process block 410 to create a new array. The play in the game may terminate once the maximum number is reached. In other implementations the total prizes awarded for the game play may include a maximum at which point the play in the game may terminate. In the event any such condition is not present as indicated by a negative outcome at decision box 412, the process loops back to process block 404 to evaluate for the triggering condition associated with the new game symbol array produced in accordance with the shifts performed at process block 410. Otherwise, if there is some terminating condition that exists as indicated by an affirmative outcome at decision box 412, the process terminates the play in the game as indicated at process block 408 and in the process returns to receive an input to initiate the next play in the game.

It should be noted that some implementations of the invention may include a script for all of the processes shown in FIG. 4. For example, the result obtained for a game play input received at process block 401 may not only dictate the result to be displayed via an initial game symbol array at process block 402 and thus the prize to be awarded at process block 403, but it may also dictate whether the process loops through one or more game symbol line shifting steps to create additional game symbol arrays. In this case the evaluation at process block 404, the shift of game symbol lines at process block 410, and the award of prizes from the additional game symbol array at process block 411 all occur however they are dictated by the single scripted result obtained for the play input received at process block 401.

Figure 5:
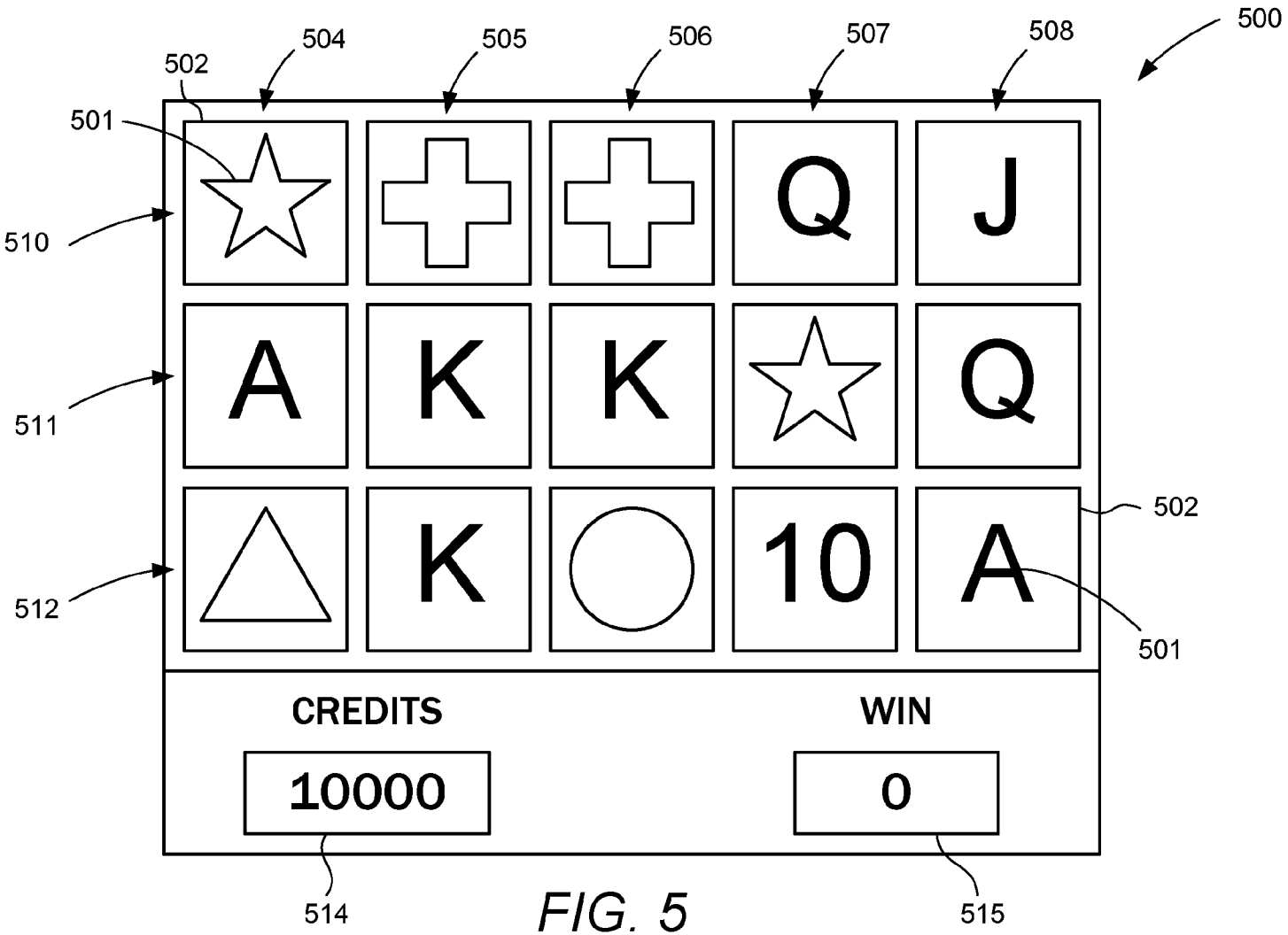
FIG. 5 is a diagrammatic representation of a game presentation including a game symbol array which may be produced for a play in a game embodying the principles of the present invention.

FIG. 5 shows a game presentation 500 that may be used in connection with FIG. 4 to describe an example process according to the present invention. Game presentation 500 includes an array of game symbols 501 at various symbol locations 502. The example array of game symbols 501 is defined by five columns of symbol locations, columns 504 through 508, and three rows of symbol locations, rows 510 through 512. It should be assumed for the purposes of this example that each column 504 through 508 of symbol locations is shown by a respective mechanical or video simulated reel. Thus this example array includes five reels with each reel defining a vertical line of symbol locations 502 and with each location populated by a particular game symbol 501. The various types of game symbols 501, the star symbol, plus symbol, circle symbol, and triangle symbol as well as the "A" through "10," that is, Ace through 10 symbols are shown only for purposes of example.

The physical or simulated reels defining columns 504 through 508 are all aligned along a horizontal rotational axis and rotate (or appear to rotate in the case of simulated reels) about that axis to change the symbols in the array. Typically the physical or simulated reels would be spun rapidly for a play in the game (such as a play initiated by the play input received at 401 in FIG. 4) and then slowly brought to a stop to produce an initial game symbol array. Shifting the lines of game symbols according to the present invention may be performed in this example by rotating the reels defining columns 504 through 508 one or more stop positions, each stop position moving symbols one location in the direction of rotation.

It will be appreciated that the invention may be employed with numerous different types of game symbol arrays in addition to the simple array shown in FIG. 5. For example, the array of game symbols need not be a rectangular array as shown in FIG. 5. Furthermore, not all locations may be populated for a given array. That is, there may be blanks in the symbol array. It is also possible for the physical or simulated reels to have a half stop positions in which symbols straddle the symbol locations shown in FIG. 5. Also, physical or simulated reels need not rotate about a horizontal axis. The array shown in FIG. 5 may alternatively be produced by three reels aligned along the vertical axis that rotate left to right or right to left about that axis to change the symbols at the various symbol locations of the array. It is also possible that a shift of reel locations according to the invention may be in one direction for one reel and in the opposite direction for another reel. Further, a player may be allowed to select the direction of shift for one or more of the lines of symbol locations defined by a reel.

Game presentation 500 also includes a display area 514 showing credits available to the player, and a display area 515 showing credits which have been won for the current play. It will be appreciated that the illustrated game presentation is a very simple presentation to facilitate describing an example of the invention without referring to additional details which are not necessary for an understanding of the present invention. Other game presentations within the scope of the invention may include numerous other types of information including game denomination, total bet for the most current play, various controls and various informational displays.

Figure 6:
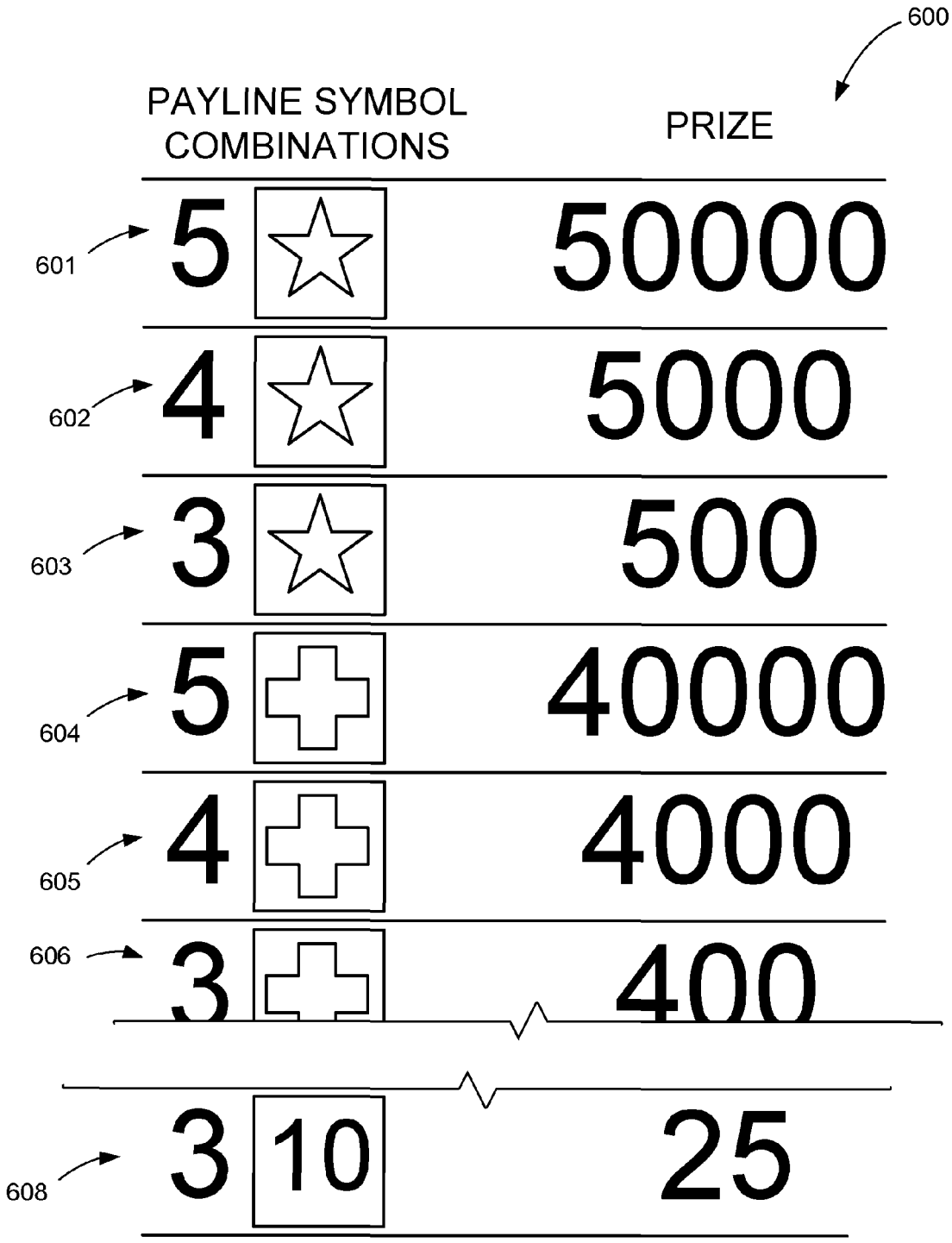
FIG. 6 is a diagrammatic representation of a portion of a pay table for the game presentation shown in FIG. 5.

FIG. 6 shows a portion of a very simplified pay table 600 that may be used in connection with the game presentations in FIGS. 5 and 7 through 9 to describe a process according to the present invention. Pay table 600 includes a number of win levels 601 through 608. Each win level includes a winning symbol combination and a prize value correlated to that winning symbol combination. For example, win level 601 includes a winning symbol combination of five "Star" symbols and this winning symbol combination corresponds to a prize of 50,000 credits.

For the purpose of the examples which will be discussed in connection with FIGS. 5 through 9, it will be assumed that all winning symbol combinations must appear from left to right and start at the first symbol column 504. It will also be assumed that only three pay lines are defined through the game symbol array, each pay line corresponding to respective row of symbol locations 510, 511, and 512. The following examples also assume that the triggering condition for purposes of triggering a shift of symbols along a line of symbol locations is any pay line win appearing in the then current game symbol array. It is also assumed that the selected number of symbol locations for each shift according to the invention is three symbol locations, and that the same shift of three symbol locations is applied to each line of symbol locations (that is, each reel defining a column 504 through 508).

With these assumptions for our examples, the condition of the array in FIG. 5 may be assumed to be a game symbol array present at the termination of the previous play. Thus FIG. 5 represents the condition of the array at the time a player enters a play input for the game at the gaming machine which implements the invention. From this point the gaming machine receives a new play input from a player corresponding to the step indicated at process block 401 in FIG. 4. This play input causes the reels defining columns 504 through 508 in FIG. 5 to spin rapidly and then ultimately slow down and stop to produce the game symbol array shown in FIG. 7. Comparing this game symbol array shown in FIG. 7 to the pay table shown in FIG. 6, it is apparent that the array shown in FIG. 7 includes two pay line wins. One pay line win is for the four "Plus" symbols aligned along row or pay line 511 producing a 4000 credit when. The other win is produced by the "Wild" symbol and then two "10" symbols aligned along row or pay line 510 producing a win of 25 credits. The total win for this portion of the game play shown in the win display area 515 comprises 4025 credits, and this combined credit value is awarded to the player by incrementing the total credits available in display 514 by the same 4025 credits.

Figure 7:
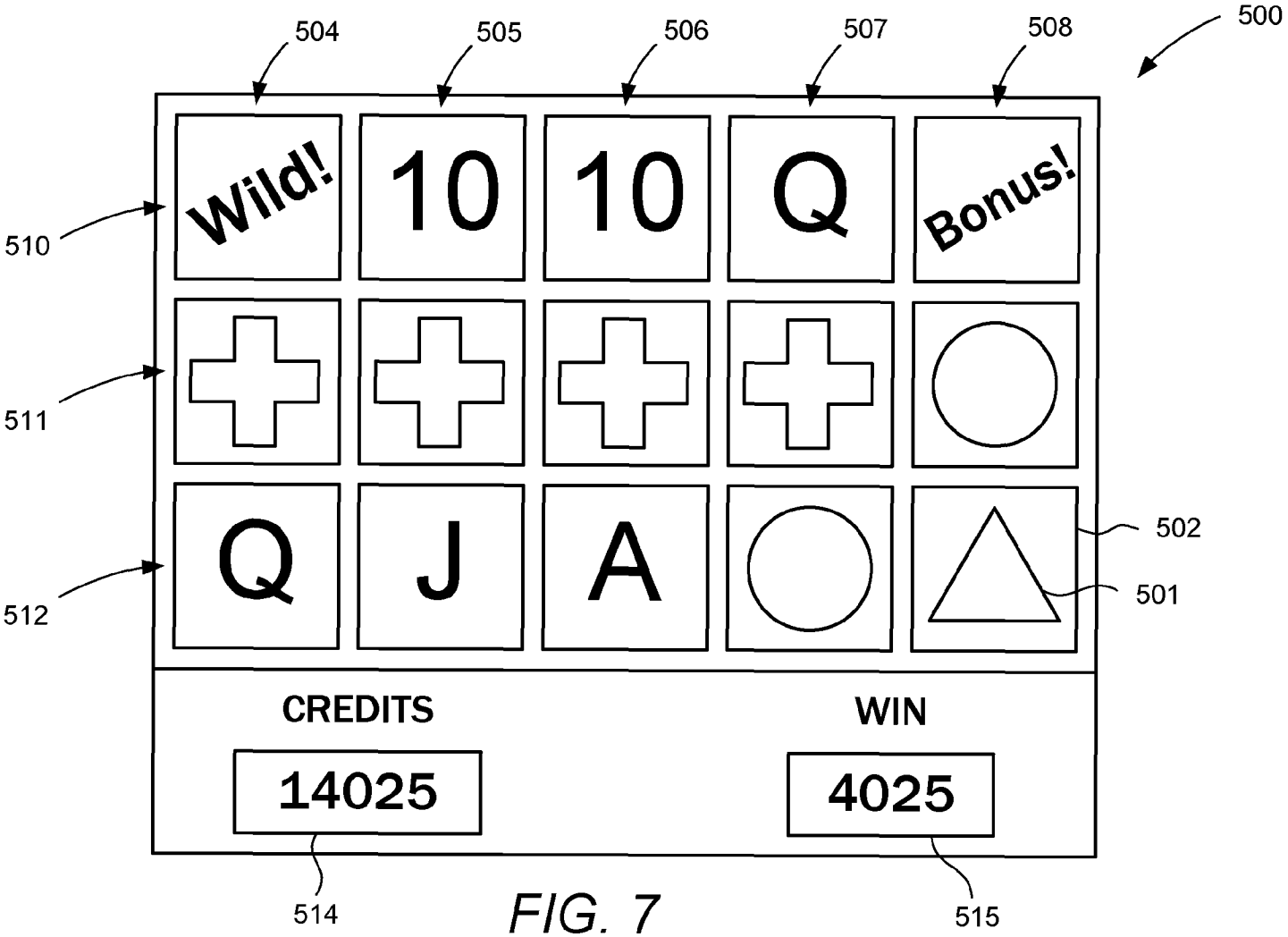
FIG. 7 is a diagrammatic representation of the game presentation shown in FIG. 5 after an initial array has been produced for a play in the game and the prizes indicated by that array have been awarded.

Because the game symbol array shown in FIG. 7 includes at least one winning combination and a winning combination is defined as the triggering condition in this example, an evaluation such as that shown at process block 404 in FIG. 4 would detect the triggering condition. Thus for this example initial game play result shown in FIG. 7, the process shown in FIG. 4 would proceed to shift the game symbol lines according to process block 410 in FIG. 4.

Figure 8:
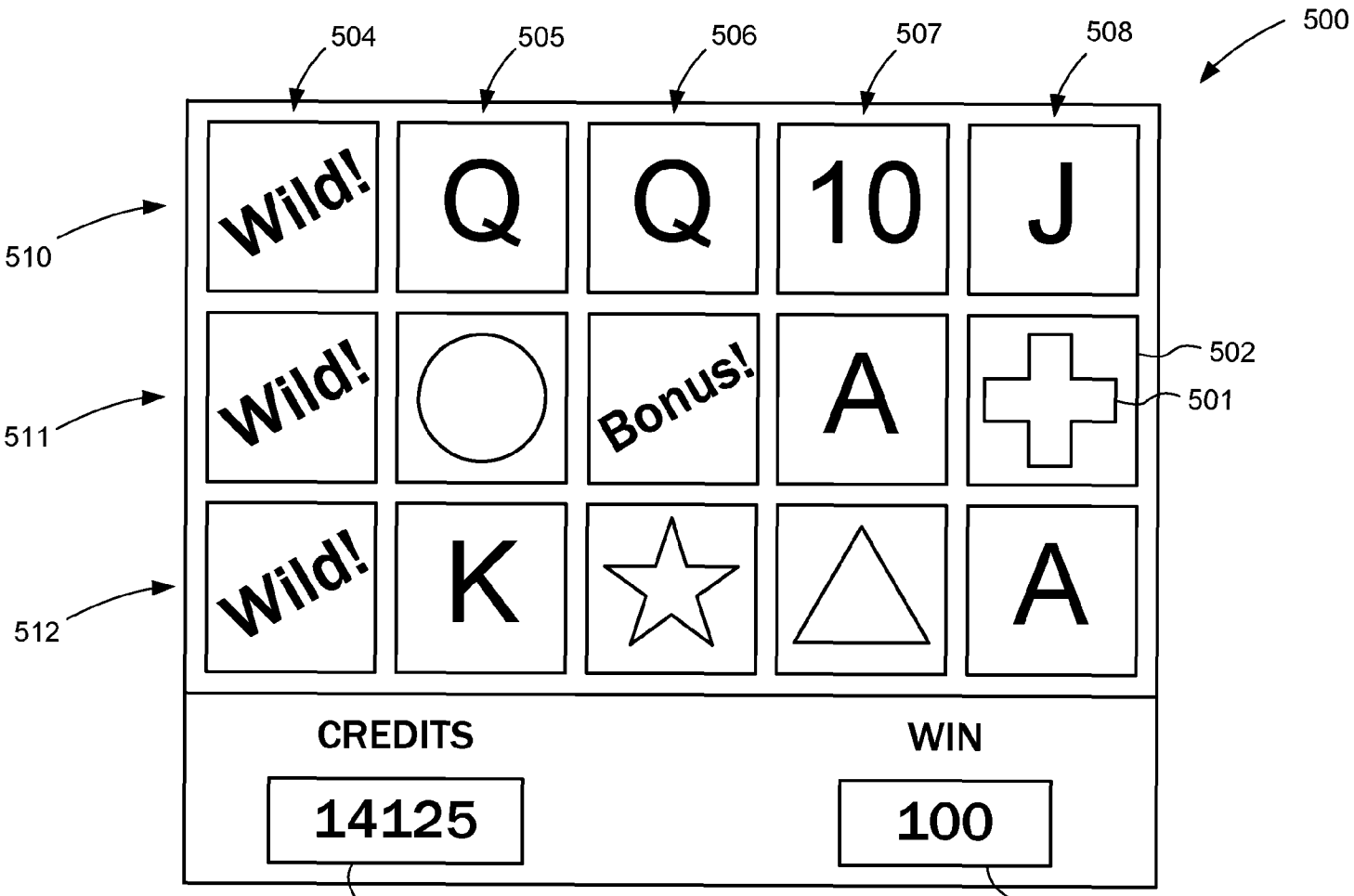
FIG. 8 is a diagrammatic representation of the game presentation shown in FIG. 5 after the game symbols have been shifted from the positions shown in FIG. 7 in accordance with an embodiment of the present invention and prizes have been awarded for the resulting new game symbol array.

FIG. 8 shows an example game symbol array produced after shifting each of the lines of game symbols (that is, the vertical columns of symbol locations in this example). According to our assumptions for this example, each line of game symbols is shifted three locations. This may be accomplished by rotating each respective reel three reel stops for a physical reel or, for simulated reels, driving the display to show a simulation of rotating three reel stops. Because this example game symbol array is only three symbols high, shifting all of the lines of game symbols three positions moves all of the game symbols shown in FIG. 7 out of the array and provides an entirely new array of game symbols in FIG. 8. Although the partial pay table 600 shown in FIG. 6 does not show this particular win level, it is assumed that the three "Q" symbols produced along the top row or pay line 510 produced by the "Wild" symbol and then two adjacent "Q" symbols is a pay line win associated with a prize value of 100 credits. The 100 credits are shown in the win display area 515 of FIG. 8 and the total credit value in display area 514 is incremented by these 100 credits which represents the award of those credits.

After the award of the 100 credits shown in FIG. 8, the process is at the position of decision box 412 in FIG. 4. It will be assumed for the purposes of this example that there is no terminating condition that would result in an affirmative outcome at decision box 412 in FIG. 4. Thus the process loops back to the evaluation step at process block 404 in FIG. 4. The evaluation here detects the winning symbol combination, defined for this example as the triggering condition, and thus the outcome at decision box 406 is again affirmative. The process thus proceeds to shift the lines of game symbols again as indicated at process block 410 in FIG. 4.

Figure 9:
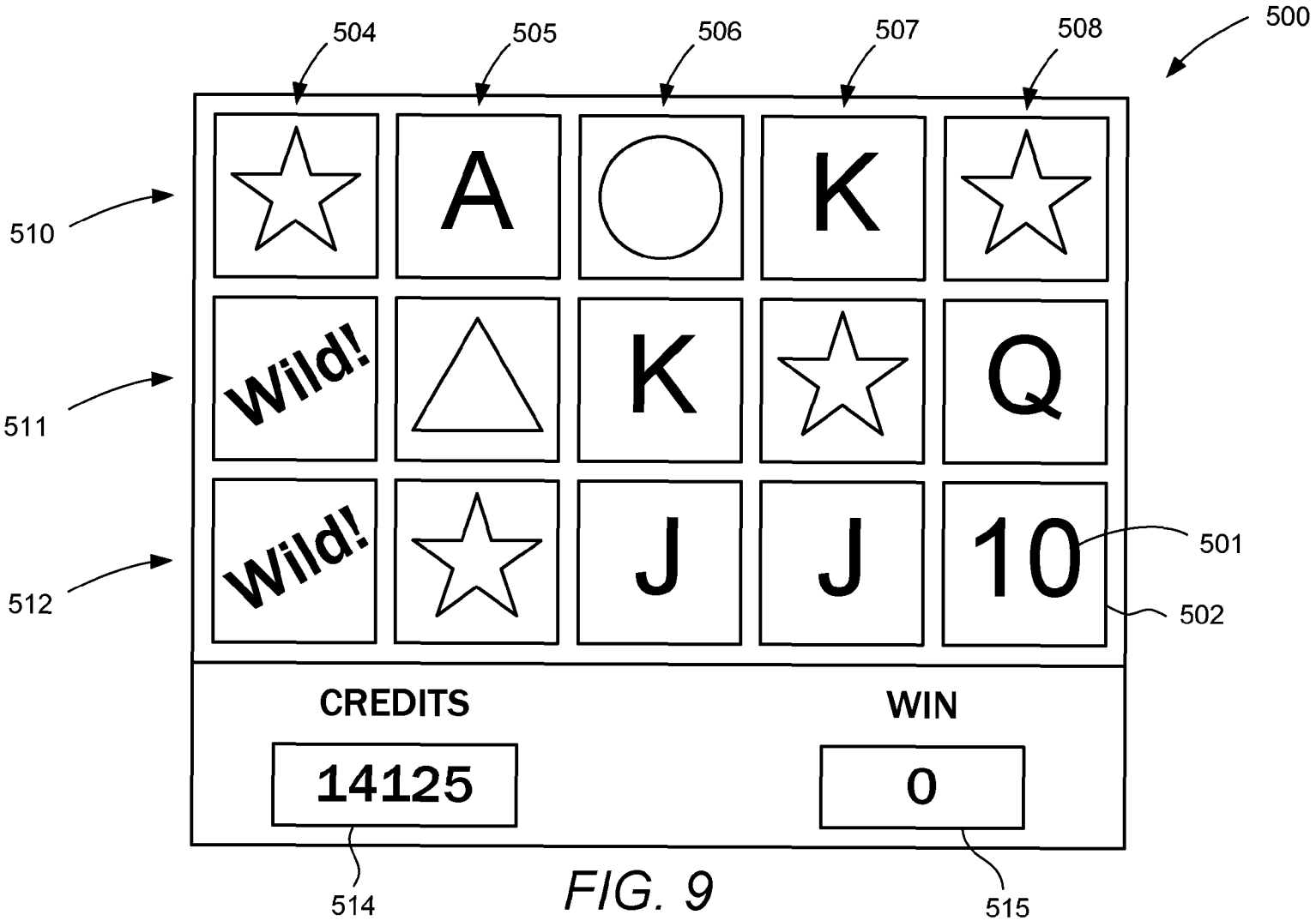
FIG. 9 is a diagrammatic representation of the game presentation shown in FIG. 5 after the game symbols have been shifted from the positions shown in FIG. 8 in accordance with an embodiment of the present invention.

FIG. 9 shows the example game presentation 500 after this second shift along the lines of symbol locations by the three symbol locations defined as the selected number of locations for this example. This resulting array shows no winning symbol combinations, thus no prizes are awarded for the array in accordance with the awarding step at process block 411 in FIG. 4.

Assuming again there is no terminating condition that would produce an affirmative outcome at decision box 412 in the process of FIG. 4, the process again loops back to the evaluation step at process block 404 in FIG. 4. The evaluation of the array shown in FIG. 9 shows no winning symbol combination and thus no triggering condition is detected in the evaluation. The outcome of the decision box 406 is therefore negative and the process proceeds to terminate that play as shown at process block 408 in FIG. 4. The process would then loop back to receive the next play input from a player at the gaming machine.

One aspect of the present invention which can generate significant player excitement is apparent from the stacked wild symbols shown in the examples of FIGS. 7 through 9. In particular, when a player knows that one of the reels includes a sequence of adjacent wild symbols, the appearance of a wild symbol in an array produced either at process block 402 in FIG. 4 or according to shift at process block 410 in FIG. 4 indicates to the player that the next shift, if one occurs, will likely include additional wild symbols in that stacked sequence. This indicates to the player that the next shift will appear to have a higher likelihood of producing winning symbol combinations in view of the expected wild symbols.

There are a number of other variations which may be included in various implementations of the present invention. For example, a game which performs symbol shifting according to the process shown in FIG. 4 may be a primary game which features one or more bonus games. One type of bonus game that may be employed is a free spin bonus in which the player is awarded one or more free spins. For example, a bonus symbol appearing in column 504, 506, and 508, may award the player some number of free spins using the same array shown in game presentation 500. The symbol shifting process described in FIG. 4 may be applied to each free spin awarded to the player. In this case the input received at process block 401 in FIG. 4 would be an activation of one of the free spins, and the symbol shifting process may be used to extend the free spin in the same way it could be used to extend a play in the primary game. In some forms of the invention, the results in the primary game might be controlled such that it would not be possible to trigger the free spin bonus and provide a triggering condition for a symbol shift in the same game symbol array (result). In other implementations, it might be possible to trigger the free spin bonus and a symbol shift in the same game symbol array, and the free spin bonus would simply start once the play in the primary game has terminated after one or more shifts as described in connection with process block 410 in FIG. 4. Furthermore, it may be possible in some implementations of the invention for a symbol shift to result in an array of game symbols that contains a bonus trigger, and thereby trigger a bonus such as a free spin bonus.

In other implementations, a player may have some impact on the selected number of symbol locations for a given shift according to the invention. For example, a player may be allowed to select the number of symbol locations for a shift or select which line or lines of symbols to shift by a number that is or is not controlled by the player. In another implementation the player may select from two or more concealed values for a shift according to the invention. It is also possible for the shifting process such as that described in FIG. 4 to be activated only on bonus plays, free spins or otherwise, or only be available for a certain bet level in the game, such as a maximum bet, or some minimum number of activated pay lines.

It will be noted that the symbol shifting step described in connection with process block 410 in FIG. 4 for a given reel is not a respin of the reel. Rather the shift is a movement of some selected number of symbol locations on the reel or simulated reel. The selected number of shifted locations will typically be a relatively small number, between one location up to the number of locations necessary to show new symbols at each position in the line of symbol locations (such as three locations in the example of FIGS. 7-9). A shift according to the invention may be of some number of locations more than the height of the game symbol array, but such a shift might tend to appear to the player as simply a randomization of the reel symbols. Even though the selected number of locations for a shift may be randomly selected (for example, from between one, two, or three locations), a shift of reel symbol locations according to the invention is not a randomization of the reel symbols for the given reel because the shift is always tied to a known starting position.

As used herein, whether in the above description or the following claims, the terms "comprising," "including," "carrying," "having," "containing," "involving," and the like are to be understood to be open-ended, that is, to mean including but not limited to. Any use of ordinal terms such as "first," "second," "third," etc., in the claims to modify a claim element does not by itself connote any priority, precedence, or order of one claim element over another, or the temporal order in which acts of a method are performed. Rather, unless specifically stated otherwise, such ordinal terms are used merely as labels to distinguish one claim element having a certain name from another element having a same name (but for use of the ordinal term).

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method for extending a play on a reel-type gaming machine, the method including:

(a) for a play on the gaming machine, producing a game symbol array through a gaming machine display system, the game symbol array including a number of lines of symbol locations and being produced by controlling the display system to populate each of at least some of the symbol locations of the game symbol array with a respective game symbol selected from one or more game symbol sets, each line of symbol locations comprising symbol locations of a physical or simulated reel of the reel-type gaming machine;

(b) awarding any prizes indicated by the game symbol array;

(c) with a processing device associated with the gaming machine, evaluating for a triggering condition associated with the then current state of game symbols in the symbol locations, and terminating the play on the gaming machine when the triggering condition is not associated with the respective current state of the game symbols;

(d) when the evaluation at step (c) of this claim for the then current state of game symbols in the symbol locations indicates that the triggering condition is associated with that current state of game symbols, producing a respective additional game symbol array through the gaming machine display system, the respective additional game symbol array being produced by shifting the game symbols populating each respective line of symbol locations in the respective current state of game symbols in a shifting direction by a selected number of symbol locations along that line of symbol locations, wherein for each respective line of symbol locations, shifting the game symbols populating that respective line of symbol locations is performed regardless of whether that respective line of symbol locations includes a symbol contributing to the triggering condition associated with that current state of game symbols;

(e) awarding any prizes indicated by the respective additional game symbol array; and (f) repeating step (c) of this claim for the respective additional game symbol array, and then repeating steps (d) and (e) of this claim when the triggering condition is associated with the respective current state of game symbols in the symbol locations.

2. The method of claim 1 wherein the selected number of symbol locations is the same for each of two or more respective additional game symbol arrays in the play on the reel-type gaming machine.

3. The method of claim 1 wherein the selected number of symbol locations is the same for each of the lines of symbol locations in the play on the reel-type gaming machine.

4. The method of claim 1 wherein the triggering condition comprises a winning pattern of symbols in that respective current state of the game symbols in the symbol locations.

5. The method of claim 1 wherein the trigger condition remains constant throughout the play on the reel-type gaming machine.

6. The method of claim 1 wherein:

(a) at least one of the lines of symbol locations is populated over the play on the reel-type gaming machine by a first sequence of game symbols which remains constant throughout the play on the reel-type gaming machine; and (b) the first sequence of game symbols includes at least two adjacent wild symbols.

7. The method of claim 1 further including, for a respective current state of the game symbols in the symbol locations, determining the value of the selected number of symbol locations from a combination of symbols included in that respective current state of the game symbols.

8. A reel-type gaming machine including:

(a) a display system;

(b) a player input system;

(c) at least one processor; and (d) at least one memory device storing instructions executable by the at least one processor to:

(i) for a play in a wagering game, produce a game symbol array through the display system, the game symbol array including a number of lines of symbol locations and being produced by controlling the display system to populate each of at least some of the symbol locations of the game symbol array with a respective game symbol selected from one or more game symbol sets, each line of symbol locations comprising symbol locations of a physical or simulated reel of the reel-type gaming machine, (ii) award any prizes indicated by the game symbol array, (iii) evaluate for a triggering condition associated with the then current state of game symbols in the symbol locations, and terminate the play in the wagering game when the triggering condition is not associated with the respective current state of the game symbols, (iv) when the evaluation at operation (iii) of this claim for the then current state of game symbols in the symbol locations indicates that the triggering condition is associated with that current state of game symbols, produce a respective additional game symbol array through the display system, the respective additional game symbol array being produced by shifting the game symbols populating each respective line of symbol locations in the respective current state of the game symbols in a shifting direction by a selected number of symbol locations along that line of symbol locations, wherein for each respective line of symbol locations, shifting the game symbols populating that respective line of symbol locations is performed regardless of whether that respective line of symbol locations includes a symbol contributing to the triggering condition associated with that current state of game symbols, (v) award any prizes indicated by the respective additional game symbol array; and (vi) repeat operations (iii) of this claim for the respective additional game symbol array, and then repeating operations (iv) and (v) of this claim when the triggering condition is associated with the respective current state of game symbols in the symbol locations.

9. The reel-type gaming machine of claim 8 wherein the instructions are also executable by the at least one processor to randomly determine the selected number of symbol locations when the evaluation operation for the then current state of game symbols indicates that the triggering condition is associated with that current state of game symbols.

10. The reel-type gaming machine of claim 8 wherein the selected number of symbol locations is the same for each of the lines of symbol locations in the play in the wagering game.

11. The reel-type gaming machine of claim 8 wherein the triggering condition comprises a winning pattern of symbols in that respective current state of the game symbols in the symbol locations.

12. The reel-type gaming machine of claim 8 wherein the instructions are also executable by the at least one processor to randomly determine the selected number of symbol locations to produce the respective additional game symbol array and to apply the selected number of symbol locations to each line of symbol locations to produce the respective additional game symbol array.

13. The reel-type gaming machine of claim 8 wherein:

(a) at least one of the lines of symbol locations is populated over the play in the wagering game by a first sequence of game symbols which remains constant throughout the play in the wagering game; and (b) the first sequence of game symbols includes at least two adjacent wild symbols.

14. The reel-type gaming machine of claim 8 wherein the instructions are also executable by the at least one processor to, for a respective current state of the game symbols in the symbol locations, determine the value of the selected number of symbol locations from a combination of symbols included in that respective current state of the game symbols.

15. A program product comprising one or more non-transitory computer readable data storage devices storing program code, the program code including:

(a) player input program code executable by at least one processor to receive a game play input entered through a player input system of a gaming machine to initiate a play in a wagering game;

(b) game program code executable by the at least one processor to:

(i) for a play in the wagering game, produce a game symbol array through a gaming machine display system, the game symbol array including a number of lines of symbol locations and being produced by controlling the display system to populate each of at least some of the symbol locations of the game symbol array with a respective game symbol selected from one or more game symbol sets, each line of symbol locations comprising symbol locations of a physical or simulated reel of the reel-type wagering game, (ii) evaluate for a triggering condition associated with the then current state of game symbols in the symbol locations, and terminating the play in the wagering game when the triggering condition is not associated with the respective current state of the game symbols, (iii) when the evaluation at operation (ii) of this claim for the then current state of game symbols in the symbol locations indicates that the triggering condition is associated with that current state of game symbols, produce a respective additional game symbol array through the gaming machine display system, the respective additional game symbol array being produced by shifting the game symbols populating each respective line of symbol locations in the respective current state of the game symbol array in a shifting direction by a selected number of symbol locations along that line of symbol locations, wherein for each respective line of symbol locations, shifting the game symbols populating that respective line of symbol locations is performed regardless of whether that respective line of symbol locations includes a symbol contributing to the triggering condition associated with that current state of game symbols, (iv) repeating operation (ii) of this claim for the respective additional game symbol array, and then repeating operation (iii) of this claim when the triggering condition is associated with the respective current state of game symbols in the symbol locations; and (c) payout program code executable by the at least one processor to award any prizes indicated by the game symbol array and each respective additional game symbol array.

16. The program product of claim 15 wherein the selected number of symbol locations is the same for each of two or more respective additional game symbol arrays in the play in the wagering game.

17. The program product of claim 15 wherein the selected number of symbol locations is the same for each of the lines of symbol locations in the play in the wagering game.

18. The program product of claim 15 wherein the triggering condition comprises a winning pattern of symbols in that respective current state of the game symbols in the symbol locations.

19. The program product of claim 15 wherein the trigger condition remains constant throughout the play in the wagering game.

20. The program product of claim 15 wherein the game program code is also executable by the at least one processor to, for a respective current state of the game symbols in the symbol locations, determine the value of the selected number of symbol locations from a combination of symbols included in that respective current state of the game symbols.

* * * * *